US010616983B1

(12) United States Patent
Lu et al.

(10) Patent No.: US 10,616,983 B1
(45) Date of Patent: Apr. 7, 2020

(54) DIMMABLE LAMP

(71) Applicant: Xiamen PVTECH Co., Ltd., Xiamen, Fujian (CN)

(72) Inventors: Fuxing Lu, Fujian (CN); Rongtu Liu, Fujian (CN)

(73) Assignee: Xiamen PVTECH Co., Ltd., Xiamen, Fujian (CN)

( * ) Notice: Subject to any disclaimer, the term of this patent is extended or adjusted under 35 U.S.C. 154(b) by 0 days.

(21) Appl. No.: 16/590,389

(22) Filed: Oct. 2, 2019

(30) Foreign Application Priority Data

Jul. 29, 2019 (CN) ..... 2019 1 0688400

(51) Int. Cl.

| | |
|---|---|
| ***H05B 33/08*** | (2020.01) |
| ***H05B 45/10*** | (2020.01) |
| ***F21V 29/61*** | (2015.01) |
| ***H05B 45/44*** | (2020.01) |
| *F21Y 115/10* | (2016.01) |
| *F21V 17/12* | (2006.01) |

(52) U.S. Cl.
CPC ..... *H05B 45/10* (2020.01); *F21V 29/61* (2015.01); *H05B 45/44* (2020.01); *F21V 17/12* (2013.01); *F21Y 2115/10* (2016.08)

(58) Field of Classification Search
CPC ..... H05B 33/08; H05B 33/0815; H05B 33/0818; H05B 33/0842; H05B 33/0845; H05B 33/0857; H05B 45/00; H05B 45/10; H05B 45/14; H05B 45/3575; H05B 45/3577; H05B 45/40
See application file for complete search history.

(56) References Cited

U.S. PATENT DOCUMENTS

| | | | | |
|---|---|---|---|---|
| 10,070,494 | B1 * | 9/2018 | Chen | H05B 33/0845 |
| 2010/0259183 | A1 * | 10/2010 | Leshniak | H05B 33/0815 315/287 |
| 2011/0101877 | A1 * | 5/2011 | Zhan | H05B 33/0815 315/206 |
| 2011/0181199 | A1 * | 7/2011 | Lin | H05B 33/0818 315/291 |
| 2014/0197760 | A1 * | 7/2014 | Radermacher | H05B 33/0815 315/307 |
| 2014/0265893 | A1 * | 9/2014 | Melanson | H05B 33/0806 315/192 |

* cited by examiner

*Primary Examiner* — Thai Pham
(74) *Attorney, Agent, or Firm* — Winston Hsu

(57) ABSTRACT

The invention provides a dimmable lamp, which is used in combination with a dimmable device outputting a dimming signal with polarity. The dimmable lamp comprises: a light emitting device for emitting light; a dimming drive module for controlling the work of the light emitting device being electrically connected with the light emitting device; a polarity conversion unit for selectively converting the polarity of the dimming signal being electrically connected to the dimmer; a signal processing unit used for processing the dimming signal being connected with the polarity conversion unit and the dimming drive module respectively to control the dimming drive module according to the dimming signal. The dimming function of the dimmable lamp can be normally realized when the dimming signal are connected at any polarity.

10 Claims, 7 Drawing Sheets

DIMMABLE LAMP

CROSS REFERENCE TO RELATED APPLICATION

This application claims priority of China Application No. 201910688400.9, filed on Jul. 29, 2019. The entirety of the above-mentioned patent application is incorporated by reference herein and made a part of this specification.

BACKGROUND OF THE INVENTION

1. Field of the Invention

The invention relates to the field of dimming device, in particular to a dimmable lamp.

2. Description of the Prior Art

At present, there are two conventional dimming lamp realization methods. The first way is to use thyristor dimming, that is, to achieve dimming by changing the conduction angle of the input ac current. The second way is through an external dimmer to output a dimming signal to control the dimming. In the second way, said dimming signal is with polarities. That is, the dimming signal has two subsignals, one is the positive signal, the other is the negative signal.

Therefore, the dimmers have signal output terminals that include positive signal output terminals and negative signal output terminals.

When installing a conventional dimmable lamp with the dimmers, if the positive signal output terminal and the negative signal output terminal are wrongly connected, will result in dimmers failure or even the whole dimmable lamp failure.

Therefore, it is necessary to design a new dimmable lamp to overcome the above problems.

SUMMARY OF THE INVENTION

In view of the problems in the prior art, the objective of the invention is to provide a dimmable lamp, which can normally realize dimming function when connected with any polarity of dimming signal.

In order to achieve the above objectives, the invention provides a dimmable lamp, which is used in combination with a dimmable device outputting a dimming signal with polarity. The dimmable lamp comprises: a light emitting device for emitting light; a dimming drive module for controlling the work of the light emitting device being electrically connected with the light emitting device; a polarity conversion unit for selectively converting the polarity of the dimming signal being electrically connected to the dimmer; a signal processing unit used for processing the dimming signal being connected with the polarity conversion unit and the dimming drive module respectively to control the dimming drive module according to the dimming signal. A dimming drive module for controlling the work of the light emitting device electrically connected with the light emitting device; A polarity conversion unit for selectively converting the polarity of the dimming signal is electrically connected to the dimmer; The signal processing unit used for processing the dimming signal connects the polarity conversion unit and the dimming drive module respectively to control the dimming drive module according to the dimming signal.

As a preferred embodiment, the dimmable lamp also includes a signal processing auxiliary power device for feeding the output signals of the dimming drive module back to the signal processing unit, which is connected between the dimming drive module and the signal processing unit.

As a preferred embodiment, the light emitting device comprises a plurality of light emitting diodes connected in series.

As a preferred embodiment, the polarity conversion unit also includes a polarity detection device for detecting the polarity of the dimming signal.

As a preferred embodiment, the dimmable lamp further comprises a lamp body and a heat dissipation device. The heat dissipation device including a rack and a cooling fan. The rack has an installation slot in a bottom thereof. The cooling fan is mounted in the installation slot by a fixing unit and has a controller controlling an operation of the cooling fan. Said fixing unit comprises a left clamp and a right clamp that secures the cooling fan; a left side of the left clamp and a right side of the right clamp have multiple sets of springs attached to an left side inner wall and right side inner wall of the installation slot, and a left end and a right end of the cooling fan are respectively attached with the left clamp and right clamp.

As a preferred embodiment, the left end and the right end of the cooling fan are respectively formed with a left securing slot and right securing slot matching a shape of the left clamp and right clamp, and the left clamp and the right clamp are respectively mounted in the left securing slot and right securing slot.

As a preferred embodiment, the shape of the left clamp and the right clamp are defined as polygons.

As a preferred embodiment, the dimmable lamp further comprises an installation device and a control circuit. The installation device includes an installation cover. The rack and the installation cover are fixed and connected by bolts.

As a preferred embodiment, the quantity of the heat dissipation device is arranged as a plurality of sets, and the distance between each of the two sets of heat dissipation device is between 5 cm-10 cm.

As a preferred embodiment, the installation cover has installation board formed thereon; and the installation cover and installation board are made of insulating material.

When the dimming signal is connected to the reverse polarity of the dimmable lamp, the polarity conversion unit can change the polarity of the dimming signal, so that the dimmable lamp can normally realize the dimming function when the dimming signal are connected at any polarity.

The following is a detailed description of the invention in combination with the attached drawings and specific embodiments, but shall not be regarded as a limitation of the invention.

BRIEF DESCRIPTION OF THE DRAWINGS

These and other features, aspects and advantages of the invention will become better understood with regard to the following embodiments and accompanying drawings.

DETAILED DESCRIPTION

Figure 1:
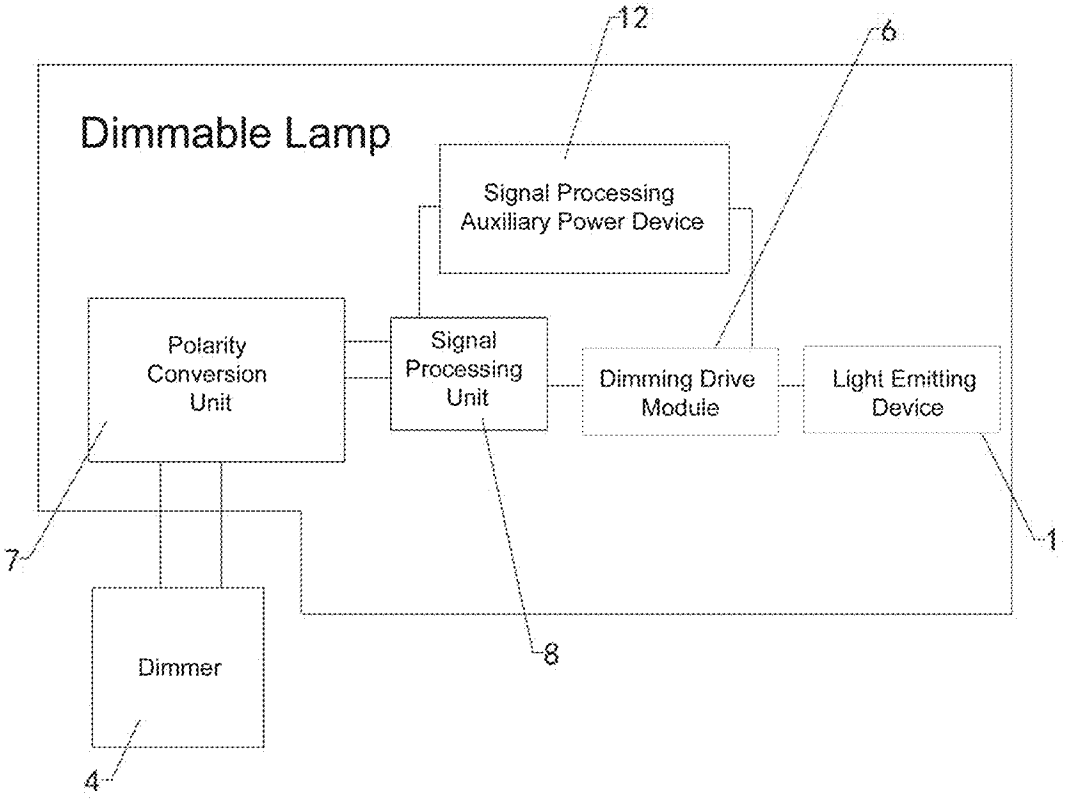
FIG. 1 is the circuit schematic diagram of the dimmable lamp and dimmer.
Figure 2:
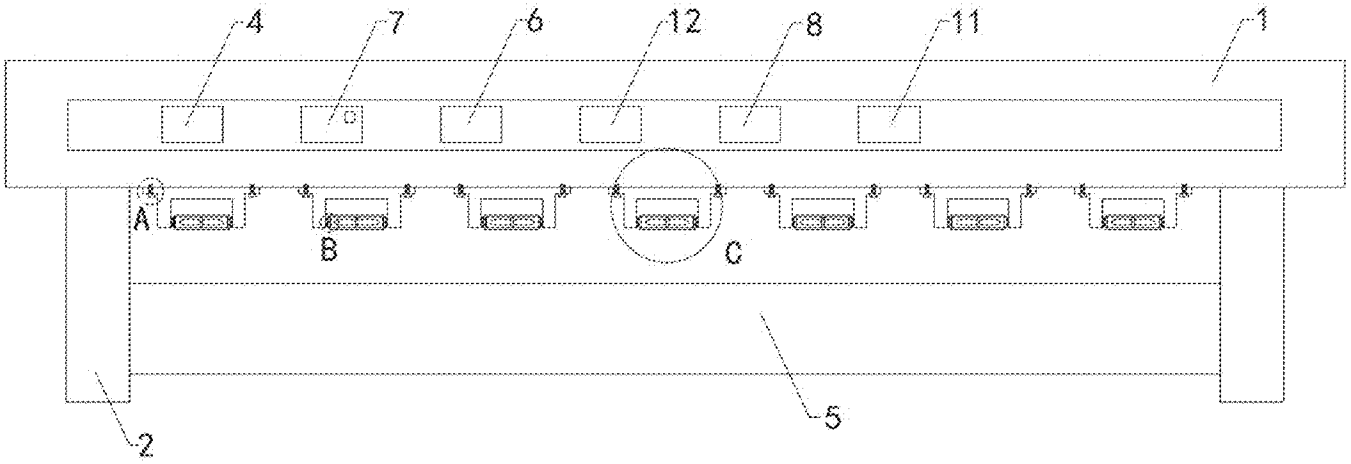
FIG. 2 is a schematic diagram of the invention.
Figure 3:
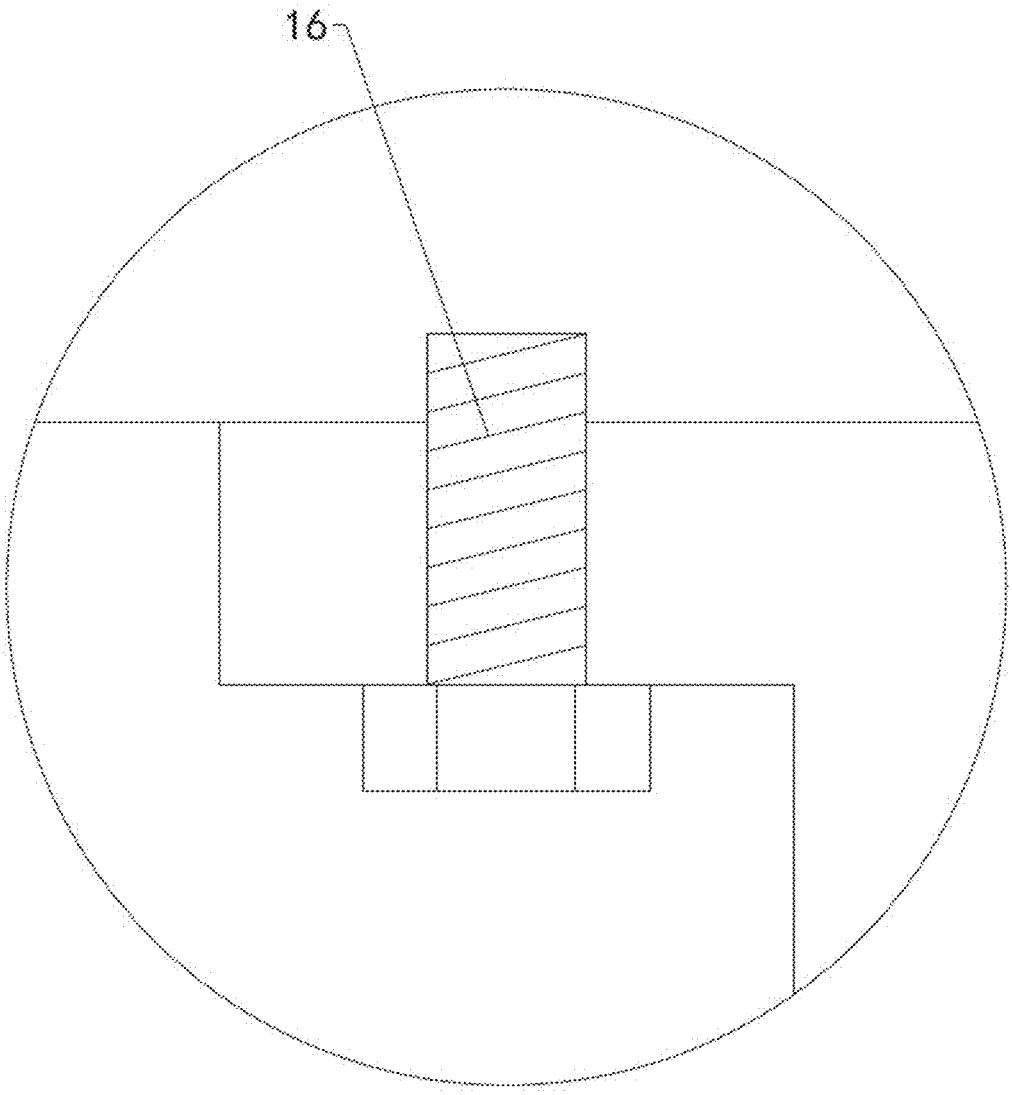
FIG. 3 is a partial enlarged schematic diagram of the structure at A in FIG. 2 of the invention.
Figure 4:
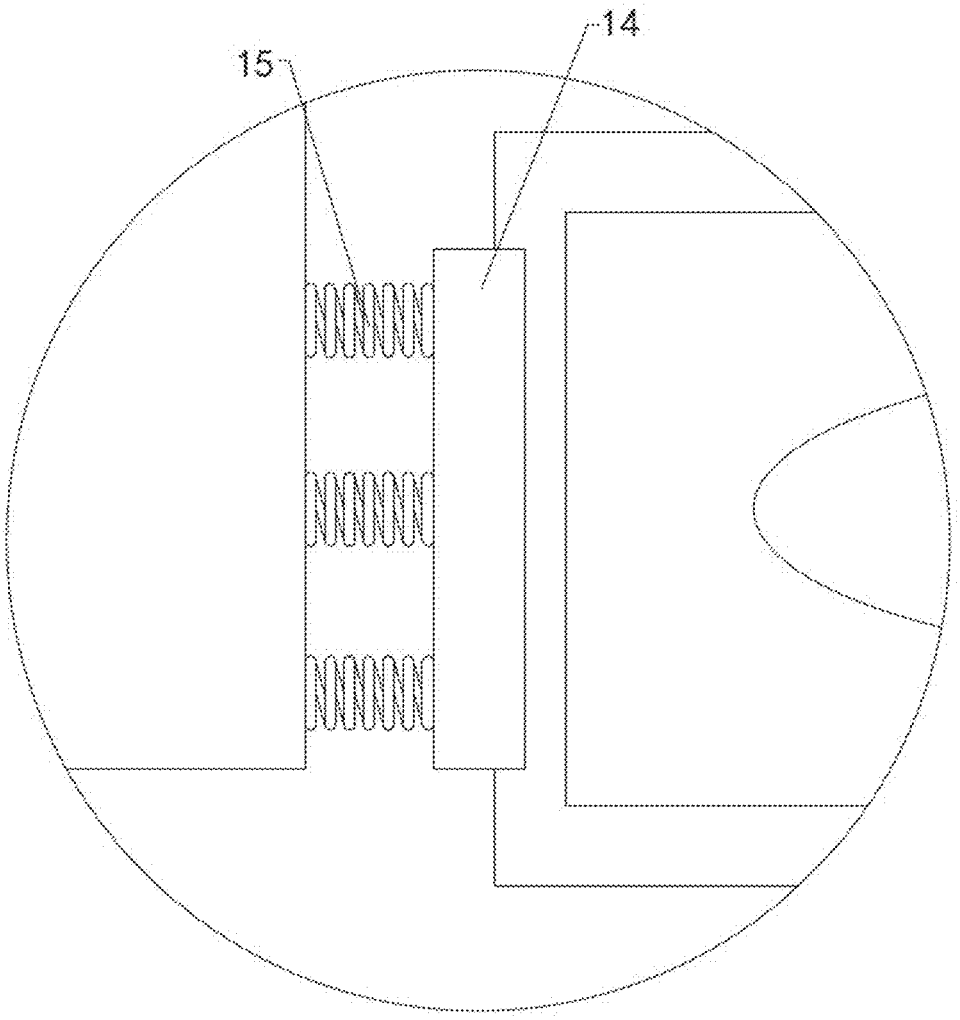
FIG. 4 is a partial enlarged diagram of the structure at B in FIG. 2 of the invention.
Figure 5:
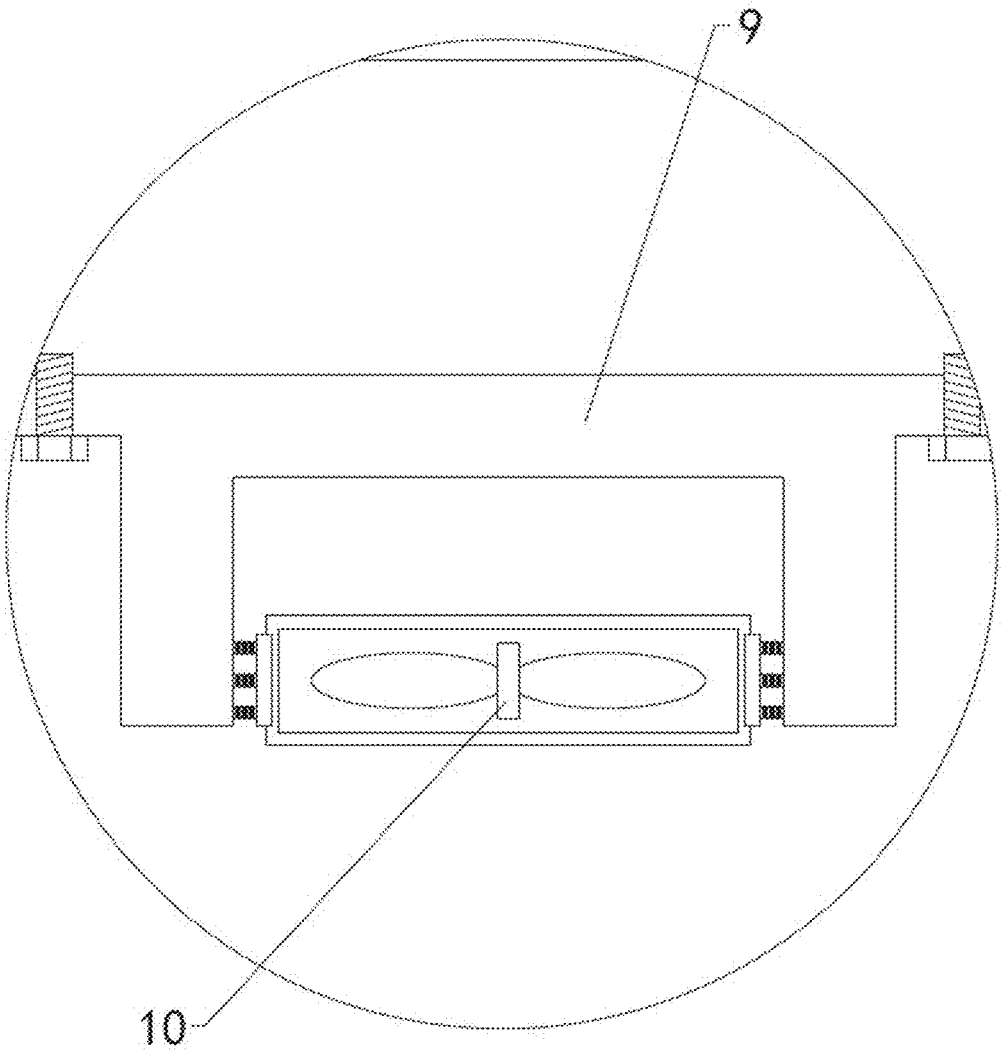
FIG. 5 is a partial enlarged schematic diagram of the structure at C in FIG. 2 of the invention.
Figure 6:
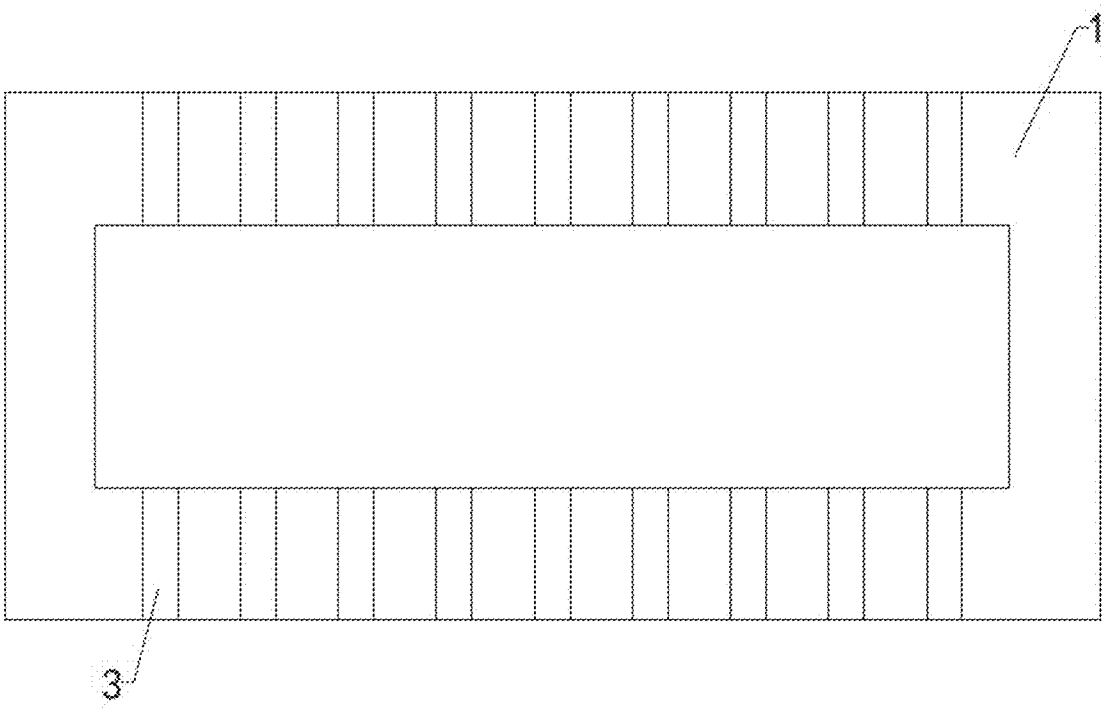
FIG. 6 is a schematic diagram of the cross section of the installation cover, the chamber and a plurality of heat dissipation through holes of the invention.
Figure 7:
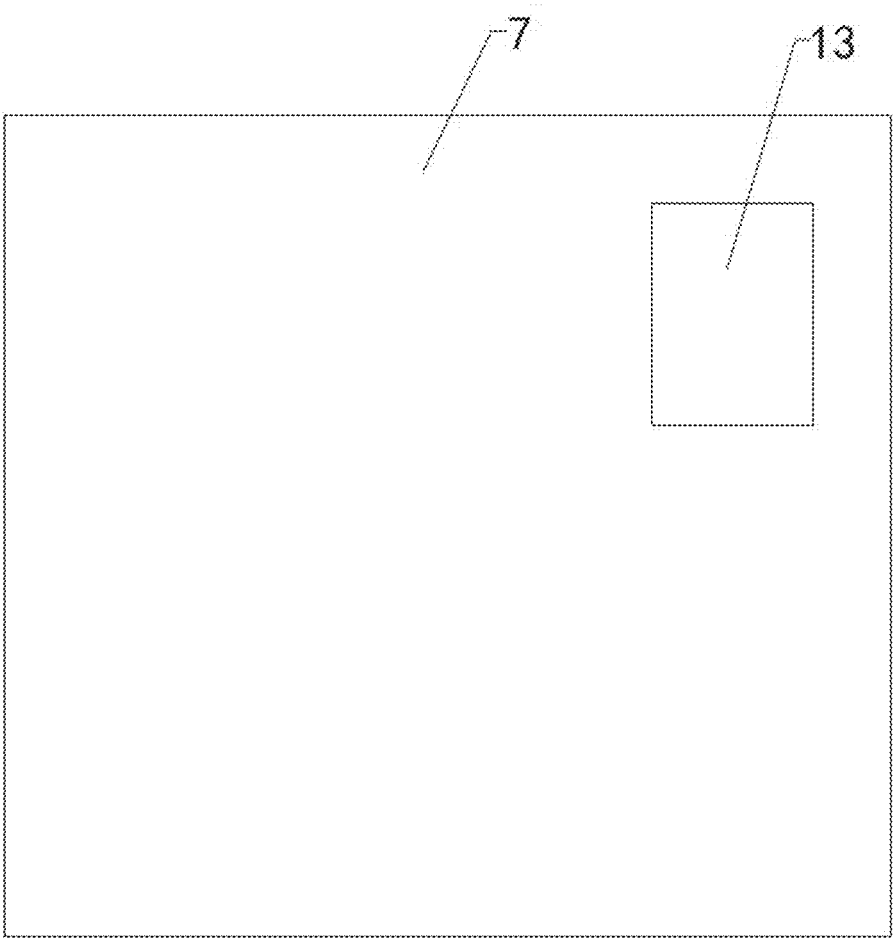
FIG. 7 is a schematic diagram of the connection between the polarity conversion unit and the polarity detection device of the present invention.

As shown in FIG. 1 to FIG. 7, the dimmable lamp of the invention is used in conjunction with a dimmer 4, which outputs a dimmer 4 signal with polarity, including positive signal and negative signal.

The dimmable lamp includes a light emitting device 5, a dimming drive module 6, a polarity conversion unit 7 and a signal processing unit 8. Among them, the signal processing unit 8 is connected with the polarity conversion unit 7 and the dimming drive module 6 respectively, the polarity conversion unit 7 and the dimming drive module 6 are electrically connected, and the dimming drive module 6 and the light emitting device 5 are electrically connected. The light emitting device 5 is used for emitting light, and the light emitting device 5 includes a plurality of light-emitting diodes connected in series. The dimming drive module 6 is used to control the work of the light emitting device 5. The polarity conversion unit 7 can selectively convert the polarity of the dimming signal. The signal processing unit 8 can control the work of the dimming drive module 6 according to the dimming signal.

The dimmer 4 that used in the present invention has positive signal output terminals and negative signal output terminals. The polarity conversion unit 7 has a first input, a second input, a first output and a second output. In this embodiment, it is defined as when the positive signal output terminals connect to the first input, and the negative signal output terminals connect to the second input, the dimmable lamp is correctly connected. Otherwise, when the positive signal output terminals connect to the second input, and the negative signal output terminals connect to the first input, the dimmable lamp is incorrectly connected.

In an embodiment of the present invention, the polarity conversion unit 7 can also comprises a polarity detection device 13 for detecting the polarity of the dimming signal that input into the first input and the second input of the polarity conversion unit 7, so that the polarity conversion unit 7 to determine whether need to convert the polarity of the dimming signal that input into the first input and the second input of the polarity conversion unit 7. When in use, if the dimming signal received by the dimmable lamp is not incorrectly connected, the polarity conversion unit 7 will not convert the polarity of the dimming signal. The first output of the polarity conversion unit 7 outputs positive signal, while the second output of the polarity conversion unit 7 outputs negative signal. If the dimming signal received by the dimmable lamp is incorrectly connected, the polarity conversion unit 7 will convert the polarity of the dimming signal, so that the first output of the polarity conversion unit 7 can still output positive signal, and the second output of the polarity conversion unit 7 can still output negative signal. That is to say, no matter whether the dimming signal is connected incorrectly, the first output of the polarity conversion unit 7 will output positive signal, and the second output of the polarity conversion unit 7 will output negative signal, so that no matter whether the dimming signal is connected incorrectly or not, the dimmable lamp can normally realize dimming function.

In another embodiment of the invention, the polarity detection device 13 and the polarity conversion unit 7 are separate units.

A first switch is connected between the polarity conversion unit 7 and the signal processing unit 8. A second switch is connected between the dimmer 4 and the signal processing unit 8. When the dimmable lamp connected to the dimmer 4 and the signal output terminals of the dimmer 4 are incorrectly connected, the first switch is on, and the second switch is off, so that the polarity conversion unit 7 changes the polarity of the dimming signal. When the dimmable lamp connected to the dimmer 4 and the signal output terminals of the dimmer 4 are correctly connected, the first switch is off, and the second switch is on, so that the polarity conversion unit 7 does not change the polarity of the dimming signal.

In this invention, the dimmable lamp also includes a signal processing auxiliary power device 12 for feeding back an output signal of the dimming drive module 6 to the signal processing unit 8. The signal processing auxiliary power device 12 is connected between the dimming drive module 6 and the signal processing unit 8. The installation of the signal processing auxiliary power device 12 allows the signal processing unit 8 to work better on controlling the dimming drive module 6.

When in use, if the dimmable lamp is not connected to the dimmer 4, the dimmable lamp can directly make the light emitting device 5 glow. At this time, the dimmable lamp only has lighting function but not dimming function. If the dimmer 4 is connected to the dimmable lamp, the dimmer 4 outputs a dimmer 4 signal to the dimmable lamp can make the dimmable lamp realize dimming.

In more detail, the dimmable lamp includes a lamp body and a heat dissipation device. The heat dissipation device is installed on the top of the dimmable lamp. The lamp body of the dimmable lamp includes an installation device and a control circuit.

Described in more detail, the installation device includes an installation cover 1 and installation boards 2 mounted longitudinally in a left side and a right side of a bottom of the installation cover 1. The installation cover has a chamber formed therein. A front side wall and a rear side wall of the chamber have multiple sets of heat dissipation through holes 3 that communicates outside environment. Said control circuit is installed inside the chamber.

Described in more detail, the control circuit includes a dimmer 4, light-emitting devices, a dimming drive module 6, a polarity conversion unit 7 and a signal processing unit 8. The dimmer 4, the polarity conversion unit 7, the dimming drive module 6 and the signal processing unit 8 are transversely arranged in the chamber, and the light-emitting devices are transversely installed in a bottom area between the installation boards 2.

In more detail, the polarity conversion unit 7 is electrically connected to the dimmer 4, the signal processing unit 8 is electrically connected to the polarity conversion unit 7 and the dimming drive module 6 respectively, and the dimming drive module 6 is electrically connected to the light emitting device 5*s*.

In more detail, the heat dissipation device including a rack 9 and a cooling fan 10. The rack 9 is mounted between the installation cover 1 and the light emitting device 5, and the top of the rack 9 is connected with the bottom of the installation cover 1. The rack 9 has an installation slot in a bottom thereof. The cooling fan 10 is mounted in the installation slot by a fixing unit.

In more detail, a controller 11 is arranged on the cooling fan 10 to control the turning on/off of the cooling fan 10. The controller 11 is disposed in the chamber and is controlling an electrical connection between the cooling fan 10 and the control circuit. The light emitting device 5 is controllably emitting light.

In more detail, the dimming drive module 6 controls the light emitting device 5 to work. The polarity conversion unit 7 selectively converts a polarity of the dimming signal. The signal processing unit 8 connects to the polarity conversion unit 7 and dimming drive module 6 respectively, so as to control the work of the dimming drive module 6 according to the dimming signal.

When the dimming signal is connected to the reverse polarity of the dimmable lamp, the polarity conversion unit 7 can change the polarity of the dimming signal, which makes the dimmable lamp functions properly to normally realize the dimming function when the dimming signal are connected at any polarity. The dimmable lamp in accordance with present invention, which has improved serviceability, and can control the cooling fan 10 by work of the controller 11. The heat of the light emitting device 5 working process is loss in time, which improves the security and the service life of the light emitting device 5. Moreover, by using of the heat dissipation through holes 3 that formed on the chamber of the installation cover 1 and communicating outside environment, heat dissipation for the components of the control circuit inside the chamber is facilitated, which improves operation reliability.

Preferably, the dimmable lamp also includes a signal processing auxiliary power device 12 in the chamber. The signal processing auxiliary power device 12 is electrically connected between the dimmable optical drive device and the signal processing unit 8. The signal processing auxiliary power device 12 can feed back an output signal of the dimming drive module 6 to the signal processing unit 8 for signal processing.

Preferably, the light emitting device 5 comprises a plurality of light emitting diodes, and the light emitting diodes are connected in series. With the characteristics of the light emitting diodes, it can reduce the working voltage and the working current, at the same time improve the impact resistance and seismic performance, improve the service reliability and service life, and facilitate the manipulation of luminous intensity.

Preferably, the polarity conversion unit 7 is provided with a polarity detection device 13. The polarity detection device 13 works independently from the polarity conversion unit 7. The polarity detection device 13 can be used to detect the polarity of dimming signal.

Preferably, the fixing unit comprising a left clamp 14 and a right clamp that secures the cooling fan 10. A left side of the left clamp 14 and a right side of the right clamp having multiple sets of springs 15 attached to a left side inner wall and right side inner wall of the installation slot. A left end and a right end of the cooling fan 10 are respectively attached with a right side of the left clamp 14 and a right side of the right clamp. A distance between the left clamp 14 and the right clamp can be adjusted by adjusting the resilience of the springs 15. With the resilience of the spring 15, it is convenient to remove and install the cooling fan 10 on the rack 9, improving the practicability.

Preferably, the left end and right end of the cooling fan 10 are respectively provided with the left securing slot and right securing slot matching the shape of the left clamp 14 and right clamp, and the right side of the left clamp 14 and the left side of the right clamp are respectively installed in the left securing slot and right securing slot. The clamping effect between the left clamp 14 and the right clamp and the cooling fan 10 can be further improved by matching the left clamp 14 and the right clamp with the clamping between the left clamp 14 and the right clamp and the cooling fan 10, so as to prevent the cooling fan 10 from falling off and improve the reliability of use.

Preferably, the shape of the left clamp 14 and the right clamp are defined as polygons; Through the stability of polygon, it can prevent the relative rotation between the left securing slot and the right securing slot on the cooling fan 10 and the left clamp 14 and the right clamp respectively, so as to improve the use stability of the cooling fan 10.

Preferably, the rack 9 and the installation cover 1 are fixedly connected by bolts 16. The bolts 16 can be removed to facilitate the installation and disassembly between the rack 9 and the installation cover 1.

Preferably, the heat dissipation device is arranged as a plurality of sets, and the distance between each of the two sets of heat dissipation device is between 5 cm-10 cm. Through the arrangement of multiple heat dissipation devices, the uniformity of heat dissipation from multiple heat dissipation devices to light emitting device 5*s* can be guaranteed and the heat dissipation effect can be improved.

Preferably, the installation cover 1 and installation board 2 are made of insulating material, so as to improve overall security.

Working process of the invention: turning on the control circuit; connecting the dimmable lamp to the dimmer 4, then that the dimmer 4 outputs a dimming signal with polarity. The dimming signal has subsignals including a positive signal and a negative signal. The dimmer 4 has a positive signal output terminal and a negative signal output terminal. The polarity conversion unit 7 has a first input terminal, a second input terminal, a first output terminal and a second output terminal. In this embodiment, the connections are defined as: when the positive signal output terminal is connected with the first input terminal and the negative signal output terminal is connected with the second input terminal, the connection is correct; when the positive signal output terminal is connected with the second input terminal and the negative signal output terminal is connected with the first input terminal, the connection is incorrect. A light emitting device 5 for emitting light. A dimming drive module 6 for controlling the work of the light emitting device 5. A polarity conversion unit 7 for selectively converting the polarity of the dimming signal. A signal processing unit 8 used for processing the dimming signal to control the dimming drive module 6 according to the dimming signal. A polarity detection device 13 for detecting the polarity of the dimming signal that input into the first input terminal and the second input terminal of the polarity conversion unit 7, so that the polarity conversion unit 7 selectively converts the polarity of the dimming signal that input into the first input terminal and the second input terminal of the polarity conversion unit 7. A first switch is connected between the polarity conversion unit 7 and the signal processing unit 8. A second switch is connected between the dimmer 4 and the signal processing unit 8.

When the dimmable lamp connected to the dimmer 4 and the signal output terminals of the dimmer 4 are incorrectly connected, the first switch is on, and the second switch is off, so that the polarity conversion unit 7 changes the polarity of the dimming signal. When the dimmable lamp connected to the dimmer 4 and the signal output terminals of the dimmer 4 are correctly connected, the first switch is off, and the second switch is on, so that the polarity conversion unit 7 does not change the polarity of the dimming signal.

The dimmable lamp further comprises a signal processing auxiliary power device 12 for feeding back an output signal of the dimming drive module 6 to the signal processing unit 8.

The signal processing auxiliary power device 12 is connected between the dimming drive module 6 and the signal processing unit 8. The installation of the signal processing auxiliary power device 12 allows the signal processing unit 8 to work better on controlling the dimming drive module 6.

When using, if the connection for the dimming signal is correct, the polarity conversion device will not convert dimming signal polarity. The first output terminal of the polarity conversion device outputs a positive signal, the second output terminal of the polarity conversion device outputs a negative signal. Otherwise, if the connection for the dimming signal is incorrect, the polarity conversion device will convert dimming signal polarity. Then the first output terminal of the polarity conversion device can still output a positive signal, the second output terminal of the polarity conversion device can still output a negative signal. That is, no matter whether the dimming signal is connected correctly or not, the dimmable lamp can achieve the dimming function normally.

When use, if the dimmable lamp is not connected with the dimmer 4, the dimmable lamp allows the light emitting device 5 to light directly, such that the dimmable lamp provide illumination function rather than dimming function. If the dimmable lamp is connected with the dimmer 4, the dimmer 4 outputs a dimming signal to the dimmable lamp can realize the dimming function of the dimmable lamp. Meanwhile, by controlling of the controller 11, the cooling fan 10 can be turn on to dissipating heat that the light emitting device 5 generated during the working process. By this way, the dimmable lamp improves the use safety and service life of the light emitting device 5. Moreover, by using the heat dissipation through holes 3 that formed on the chamber of the installation cover 1 and communicating outside environment, heat dissipation for the components of the control circuit inside the chamber is facilitated. When need to remove the cooling fan 10, the user may compress the spring 15 directly, to increase the distance between the left clamp 14 and right clamp, and detach the left clamp 14 and the right clamp from the left securing slot and the right securing slot, so as to remove the cooling fan 10.

To sum up, the dimmable lamp of the invention is equipped with a polarity conversion unit 7. When the dimming signal is incorrectly connected, the polarity conversion unit 7 can change the polarity of the dimming signal, so that the dimmable lamp can normally realize the dimming function.

The electrical components in this specification are all connected with the external main controller and 220V mains electricity, and the main controller can be the conventional known equipment controlled by computer.

By elaborating the better embodiments above, it is hoped that the characteristics and spirit of the invention can be more clearly described, rather than limiting the protection scope of the invention by referring to the better embodiments disclosed above. Rather, it is intended to cover changes and equal arrangements within the protection of claims to which the invention is intended to apply. The scope of protection of the claims of the invention shall therefore be interpreted in the broadest terms according to the foregoing so as to cover all possible variations and arrangements of equality.

What is claimed is:

1. A dimmable lamp, which is in combination with a dimmer that outputs a dimming signal with polarity, comprising:

a light emitting device for emitting light;

a dimming drive module for controlling the work of the light emitting device electrically connected with the light emitting device;

a polarity conversion unit for selectively converting the polarity of the dimming signal being electrically connected to the dimmer; and a signal processing unit for processing the dimming signal being connected to the polarity conversion unit and the dimming drive module respectively to control the dimming drive module according to the dimming signal.

2. The dimmable lamp as claimed in claim 1, wherein the dimmable lamp further comprises a signal processing auxiliary power device for feeding back an output signal of the dimming drive module to the signal processing unit, the signal processing auxiliary power device being connected between the dimming drive module and the signal processing unit.

3. The dimmable lamp as claimed in claim 1, wherein the light emitting device includes a plurality of light-emitting diodes connected in series.

4. The dimmable lamp as claimed in claim 1, wherein the polarity conversion unit further comprises a polarity detection device for detecting the polarity of the dimming signal.

5. The dimmable lamp as claimed in claim 1, wherein the dimmable lamp further comprises:

a lamp body; and a heat dissipation device including a rack having an installation slot in a bottom thereof; and a cooling fan being mounted in the installation slot by a fixing unit and having a controller controlling an operation of the cooling fan;

said fixing unit comprising a left clamp and a right clamp that secures the cooling fan; a left side of the left clamp and a right side of the right clamp having multiple sets of springs attached to an left side inner wall and right side inner wall of the installation slot.

6. The dimmable lamp as claimed in claim 5, wherein a left end and a right end of the cooling fan are respectively formed with a left securing slot and right securing slot matching a shape of the left clamp and right clamp, and the left clamp and the right clamp are respectively mounted in the left securing slot and right securing slot.

7. The dimmable lamp as claimed in claim 5, wherein the shape of the left clamp and the right clamp are defined as polygons.

8. The dimmable lamp as claimed in claim 5, wherein the dimmable lamp further comprises:

an installation device including an installation cover; and a control circuit;

wherein the rack and the installation cover are fixed and connected by bolts.

9. The dimmable lamp as claimed in claim 5, wherein the quantity of the heat dissipation device is arranged as a plurality of sets, and a distance between each of the two sets of heat dissipation device is between 5 cm-10 cm.

10. The dimmable lamp as claimed in claim 5, wherein the installation cover has installation board formed thereon; and the installation cover and installation board are made of insulating material.

* * * * *